US006740052B1

(12) United States Patent
Regner

(10) Patent No.: US 6,740,052 B1
(45) Date of Patent: May 25, 2004

(54) FOOT SCRUBBER

(76) Inventor: Roger Regner, 2303 McDuffie, Hou., TX (US) 77019

( * ) Notice: Subject to any disclaimer, the term of this patent is extended or adjusted under 35 U.S.C. 154(b) by 0 days.

(21) Appl. No.: 10/217,770

(22) Filed: Aug. 13, 2002

Related U.S. Application Data

(60) Provisional application No. 60/311,906, filed on Aug. 13, 2001.

(51) Int. Cl.[7] ..... A61H 7/00
(52) U.S. Cl. ..... 601/136
(58) Field of Search ..... 601/134, 136–138, 601/27; D24/211, 214

(56) References Cited

U.S. PATENT DOCUMENTS

| | | | | |
|---|---|---|---|---|
| 2,591,331 A | | 4/1952 | Baumbach | |
| 2,852,793 A | | 9/1958 | Shelton | |
| 3,543,747 A | | 12/1970 | Gustafson | |
| 3,548,439 A | | 12/1970 | Berst | |
| 3,973,286 A | | 8/1976 | Logan | |
| 4,076,876 A | * | 2/1978 | Bowles | 428/71 |
| 4,532,668 A | | 8/1985 | Slonicki | |
| 4,617,917 A | | 10/1986 | Miller | |
| 4,918,779 A | | 4/1990 | Burns | 15/104.92 |
| 4,976,049 A | * | 12/1990 | Myers | 36/8.1 |
| 5,605,533 A | * | 2/1997 | Badilla | 601/103 |
| 5,685,828 A | * | 11/1997 | Dyck | 601/112 |
| 5,813,078 A | * | 9/1998 | Hogan, Sr. | 15/160 |
| 6,013,042 A | * | 1/2000 | Sakai | 601/134 |

FOREIGN PATENT DOCUMENTS

| | | | |
|---|---|---|---|
| DE | 3228638 | * | 2/1984 |
| FR | 2579458 | * | 10/1986 |
| JP | 63-317153 | * | 12/1988 |
| JP | 20014646463 | * | 2/2001 |

* cited by examiner

*Primary Examiner*—Danton D. DeMille
(74) *Attorney, Agent, or Firm*—Kenneth A. Roddy

(57) ABSTRACT

A foot scrubbing implement used in the shower or bath to wash and exfoliate skin of feet. The foot scrubber (1) holds a washing and scrubbing surface (8) in an outwardly curved, dome like shape. This domed shaped scrubbing surface (8) allows all areas of the feet (Balls of feet, toes, arches and side of foot and heal) to be scrubbed. The scrubbing surface (8) is made from materials suitable for cleaning and exfoliating the tougher skin of the feet. The foot scrubber (1) is held in place by standing on the flat bottom portion (2) with one foot, thus allowing the other foot to rubbed back and forth on the top portion. The shape and texture of the scrubbing surface provides an effective way to exfoliate both bottom and sides of feet. The foot scrubber is small and lightweight. It is constructed of materials that rinse out and dry quickly.

2 Claims, 6 Drawing Sheets

FOOT SCRUBBER

CROSS REFERENCE TO RELATED APPLICATION

This application claims priority of U.S. Provisional Application Ser. No. 60/311,906, filed Aug. 13, 2001.

BACKGROUND OF THE INVENTION

1. Field of the Invention

This invention relates to foot cleaning and scrubbing devices used in the shower or bath.

2. Discussion of Prior Art

Foot hygiene includes cleaning and smoothing of skin on sides and bottom of feet. The outside edge of the big toe and the sides of the heel are the most common places for rough callused skin. Traditional hand operated wash cloths and brushes can be used but require the person to stand on one foot or to sit-down. When taking a shower it may not be possible to stand on one foot or sit down.

It would therefore be desirable to provide a foot-operated foot scrubbing implement. The foot is quite strong and agile and could care for itself it given the right stationary implement to rub or work against.

There are numerous stationary implements in the prior art designed to rub and clean the foot. These items are typically a brush or sponge implement that is fastened to the floor (or tub wall) with suction cups. One disadvantage of the suction cup design is that many cups over an extended periphery are needed to hold the implement steady. A second disadvantage of the suction cup design is it requires the person to bend over and pull it up from the floor after use. A third disadvantage of the suction cup design is that because the implement is securely fastened to the floor, a tripping hazard results.

Many prior art devices have limited operability. For example, prior art devices having flat surfaces with one or more straight sides or those wherein the implement is contoured with the working surface disposed on a concave curve, like bristles on the inside of a large shoe. These surface shapes actually limit the possible areas on the foot where rubbing pressure can be exerted. A convex shaped surface like the outside surface of a sphere would allow more possibilities.

Some prior art devices typically use a bristled brush scrubbing surface. Tile bristled brush type implements do not effectively smooth the dry callused skin of the feet. If a person wanted to smooth a small callused area on the big toe or heel, the person would concentrate extra pressure on that area, but when the foot is pressed hard against a brush the bristles just bend over and no smoothing results. The bristled brush by nature is unattractive and often associated with roughness, pain and hard work.

The prior art has presented solutions for cleaning the foot, but has not adequately solved the problem of smoothing the rough areas around calluses.

The size and weight of most prior art foot scrubbing implements is not optimal for easy movement of the implement to and from storage within the shower area.

SUMMARY OF THE INVENTION

It is therefore an object of the present invention to provide a foot scrubbing device that is held stationary by inserting a foot and standing on it, and which is small in size, can easily be picked up or repositioned about the shower floor, is easily stored away within the shower area, and is not securely fastened to the bath floor, and therefor not a tripping hazard.

It is another object of this invention to provide a foot scrubbing device that has good operability due to an outwardly curved dome-shaped scrubbing surface that allows the user's foot to be moved across the scrubbing surface in a multitude of locations and directions and allows the user to concentrate pressure on many small areas of the foot.

Another object of this invention is to provide a foot scrubbing device that has an outwardly curved symmetrical scrubbing surface so that the right and left foot are presented matching surfaces to rub on and has vertical areas where the sides of feet can be cleaned and smoothened.

Another object of this invention is to provide a foot scrubbing device having an outwardly curved dome-shaped scrubbing surface that is ideal for cleaning and smoothing the arch of the foot, which is not possible with any-concave or flat shaped surface, and provides pleasure by rubbing the arch of the foot on the dome-shaped surface.

Another object of this invention is to provide a foot scrubbing device having an outwardly curved scrubbing surface that curves up and over the foot that holds it in place allowing for a very compact, lightweight implement whereby rubbing a foot on the curved surface over the other foot is much like naturally rubbing the feet together.

Another object of this invention is to provide a foot scrubbing device having an outwardly curved scrubbing surface which can be made of various fabrics and materials with a wide range of textures to allow pressure to be exerted on a small area of the skin to achieve improved exfoliation and smoothening, provide a nice appearance, and a selection of many pattern and color combinations to choose from.

A further object of this invention is to provide a foot scrubbing device having an outwardly curved scrubbing surface which may be made from the sponges and bristled brush material.

A still further object of this invention is to provide a foot scrubbing device having an outwardly curved shape and a sturdy scrubbing surface that provides an effective means to smoothen rough callused skin of the foot.

Other objects of the invention will become apparent from consideration of the drawings and ensuing specification and claims.

The above noted objects and other objects of the invention are accomplished by a foot scrubber that is used in the shower or bath that is held in place by one toot of a user and has an outwardly curved dome-shaped scrubbing surface that curves up and over the foot that is holding it in place. The user's other foot is rubbed against the scrubbing surface. The outwardly curved shape of the scrubbing surface allows all areas of the feet to be scrubbed (Balls of feet, toes, arches and sides of foot and heel).

DESCRIPTION OF THE PREFERRED EMBODIMENTS

Figure 1:
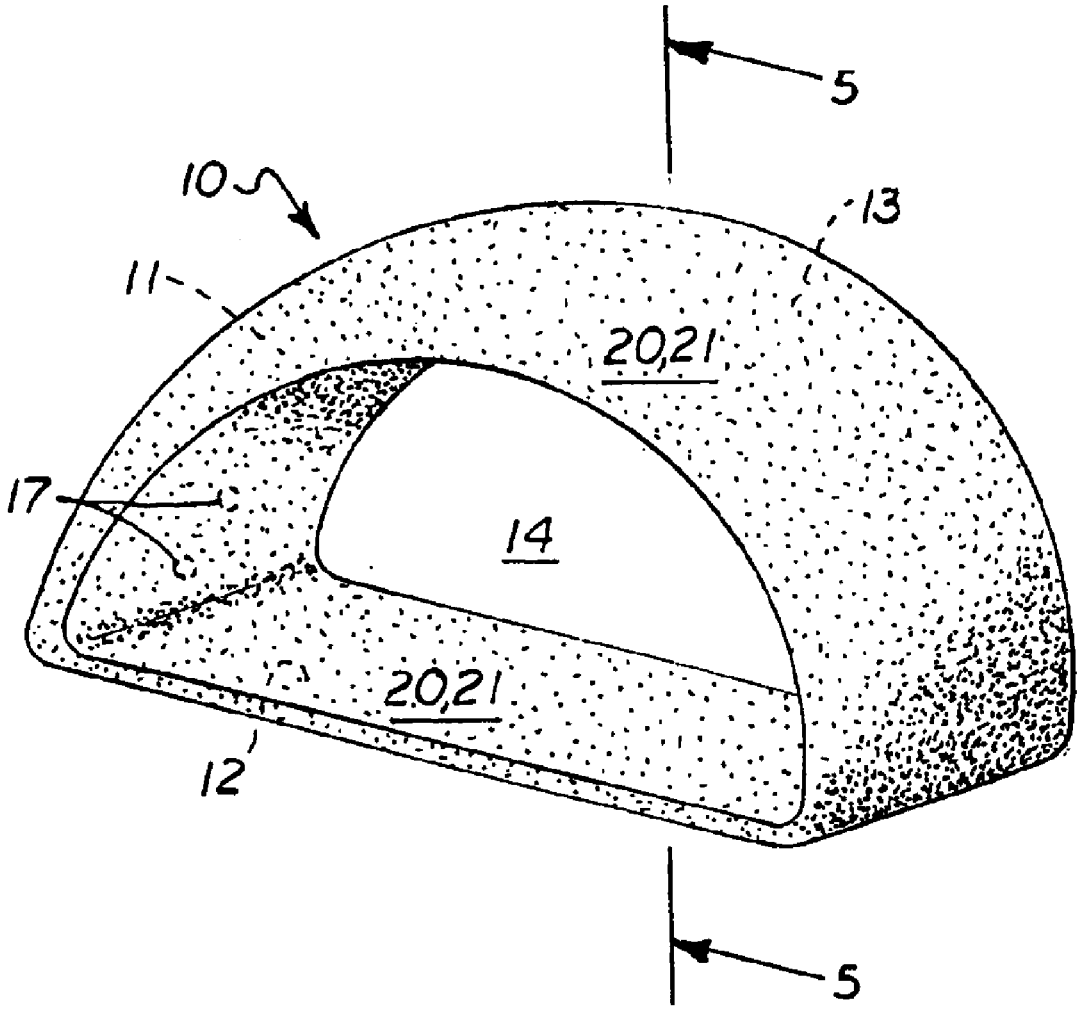
FIG. 1 is a perspective view of a foot scrubber in accordance with the present invention.
Figure 2:
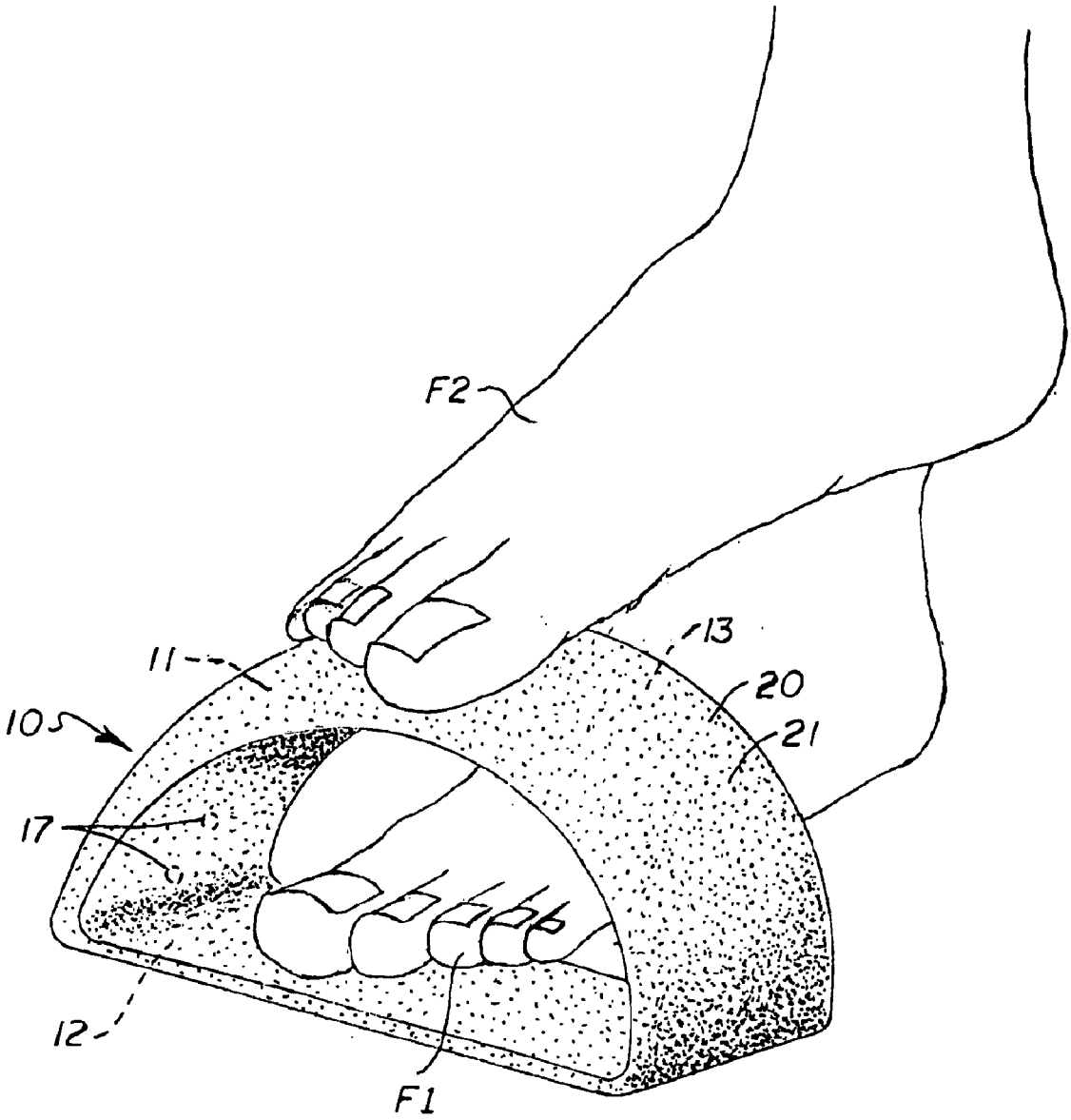
FIG. 2 is a perspective view showing the foot scrubber in use.
Figure 3:
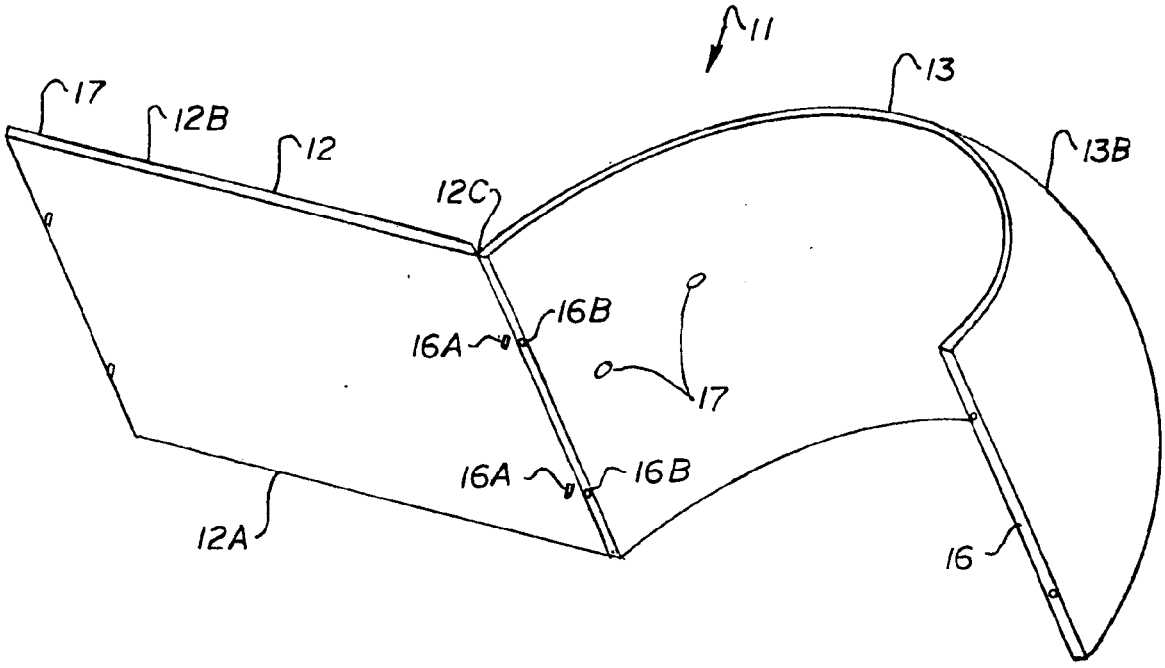
FIG. 3 is a perspective view from the bottom of a rigid hinged frame member with hinge open.
Figure 4:
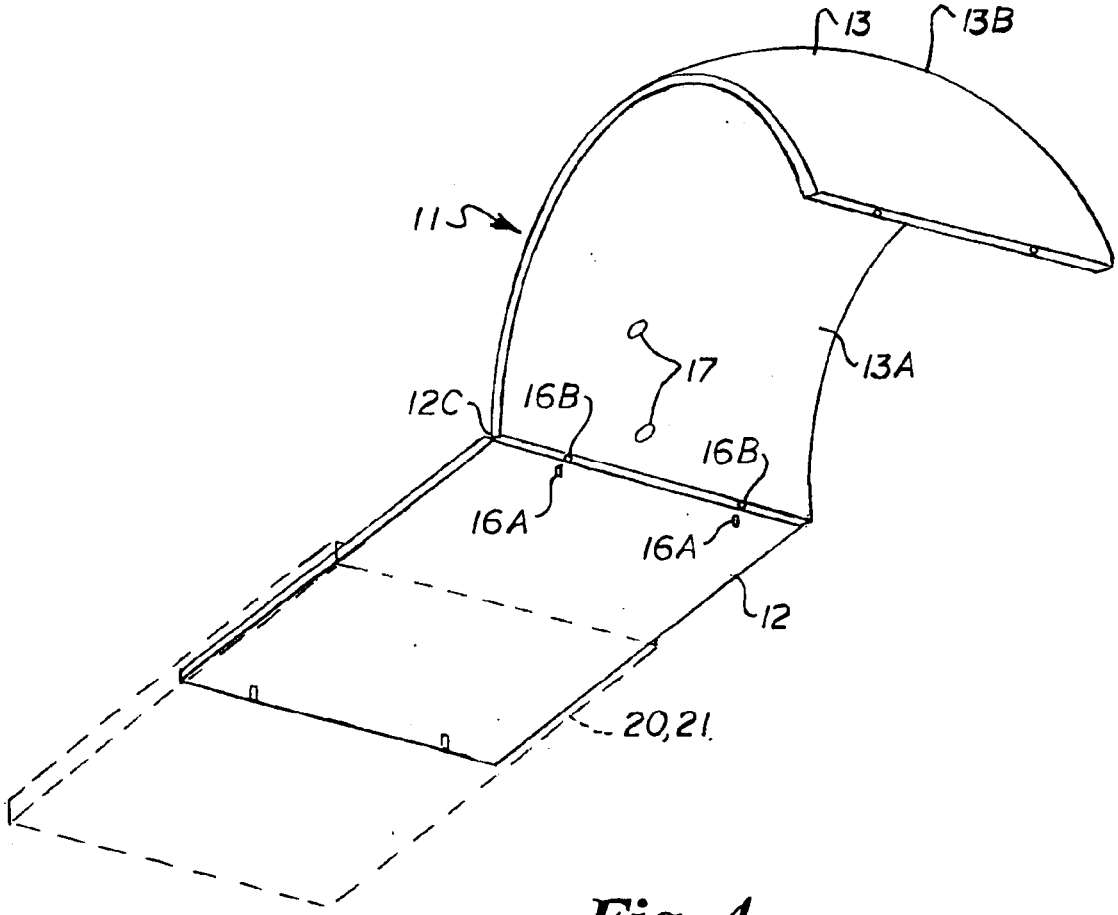
FIG. 4 is a perspective view showing a sleeve of textured scrubbing material being slid over the rigid frame member.
Figure 5:
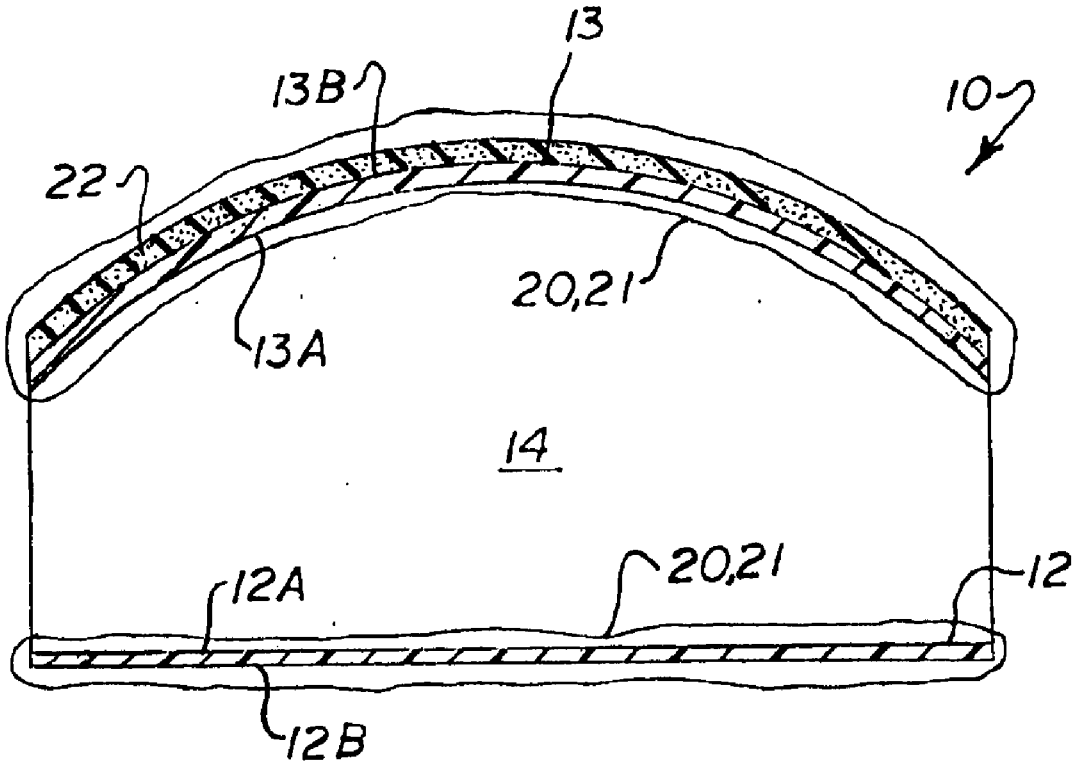
FIG. 5 is a cross section view taken along line 5—5 of FIG. 1, showing the scrubbing material and rigid frame member.

Referring now to the drawings by numerals of reference, FIG. 1 shows a foot scrubber 10 in accordance with the present invention, and FIG. 2 shows the foot scrubber in use. FIG. 3 shows a rigid hinged frame member 11 and FIG. 4 shows a sleeve 20 of textured scrubbing material 21 being slid over the frame member 11. FIG. 5 shows the frame member 11 and sleeve 20 of scrubbing material 21 in cross section.

The rigid frame member 11 is a generally D-shaped configuration, preferably formed or molded of polypropylene. Alternate materials include polyethylene, flexible polyurethane foams, sponge material, other waterproof polymers and natural materials.

The rigid frame member 11 has a generally rectangular bottom portion 12 with inner and outer facing surfaces 12A and 12B, respectively, and an outwardly curved, generally dome-shaped top portion 13 which extends upwardly from laterally opposed sides of the bottom portion 12 and over and above the bottom portion to define a generally D-shaped opening 14, for receiving one foot F1 of the user. The top portion 13 also has inner and outer facing surfaces 13A and 13B, respectively. As described hereinafter, the outer facing surface 13B of the top portion 13, or the inner and outer facing surfaces 13A, 13B, of the top portion and inner and outer surfaces 12A, 12B of the bottom portion 12, are covered with textured scrubbing material 21. As shown in FIG. 2, the foot scrubber 10 is held against a flat support surface (such as a shower floor) by the user placing one foot F1 into the D-shaped opening 14, and exerting force on bottom portion 12 by standing on it. This holds the foot scrubber stationary. The user's other foot F2 is free to rub and scrub against the textured scrubbing material 21 on the outer facing surface of the top portion 13.

Referring now to FIGS. 3 and 4, the generally rectangular bottom portion 12 of the frame 11 may be connected at one side to one side of the curved, generally dome-shaped top portion 13 by a hinge 12C, which is shown in the open position. The hinge 12C is secured in a closed position by pressing a male engagement element 16A into a female engagement element 16B. When the bottom portion 12 is closed, it forms a connection between the two sides of the top portion 13. This makes the frame member 11 more rigid. The sides of the frame member may be provided with drain holes 17, to keep water from collecting in this region when foot scrubber 10 is hung up to dry.

FIG. 4 shows a tubular sleeve 20 of textured scrubbing material 21, being slid over the rigid frame member 11. It is preferred that the scrubbing material sleeve 20 be tubular shape and of uniform diameter. Preferably the rigid frame member 11 is shaped to accept the scrubbing material sleeve 20. Utilizing a scrubbing material sleeve 20 facilitates ease of manufacturing and low price.

The sleeve 20 of scrubbing material can be made from various fabrics. One preferred commercially available fabric is called raffia fabric. This is a knitted tubular fabric made of plastic split film (flat) thread and a multi nylon filament thread. Tile fabric is knitted so that the split film (flat) thread forms a raised loop. The edges of the raised loop work like small flexible scrapers. The fabric has approximately 200 raised loops per square inch. The raffia fabric is excellent for cleaning and exfoliating the skin of the feet. It is also good at smoothing the rough skin around calluses.

Another preferred fabric is made by Salux Co. LTD., Tokyo, Japan, and is described in U.S. Pat. No. 3,604,474, which is incorporated herein by reference. The fabric is made of synthetic monofilament thread. 3M's Scotch-Brite "Dobie" ® cleaning pad and the "TUFFY" ® scouring pad are other examples of a suitable scrubbing material.

Other suitable scrubbing materials include natural plant fiber, sponges, sponges with abrasive particles, cellular foam materials, netting, mesh, and plastic polymers. The appearance, durability and degree of roughness are a function of the material used.

Alternatively, a layer of the scrubbing material 21 may be laid over the outer facing surface 13B of the top portion 13 of the rigid frame member 11 and secured at the edges. One or more kinds of scrubbing material may be used to provide different levels of smoothness or coarseness. This approach would allow the product to be tailored to people's specific needs.

Other alternatives to the tubular sleeve include a bristle brush incorporated into the top portion 13, or abrasive particles similar to the flexible emery boards available for fingernails.

FIG. 5 shows a transverse cross sectional view of the preferred embodiment of the foot scrubber 10 taken along line 5—5 of FIG. 1, wherein the tubular sleeve 20 of scrubbing material 21 surrounds the rigid frame member 11. The scrubbing material also functions as a non-slip surface.

Optionally, as seen in FIG. 5, a layer of cushioning material 22 may be disposed between the outer facing surface 13B of the top portion 13 of the rigid frame member 11, and the interior of the sleeve 20 of scrubbing material. The cushioning material 22 provides comfort for people with tender feet. The cushioning material 22 may be made of various waterproof materials, for example, foam weather striping material and gel cushioning material of the type conventionally used for shoe inserts.

Operation

Prior to use, the scrubbing material 21 is wetted and soap is applied thereto. As shown in FIG. 2 and somewhat schematically in FIG. 6, the user places the foot scrubber 10 on the flat surface of the shower or bathtub and places one foot F1 through the D-shaped opening 14 and stands on the bottom portion 12 to hold the scrubber stationary and rubs the other foot F2 over the scrubbing material.

Figure 6:
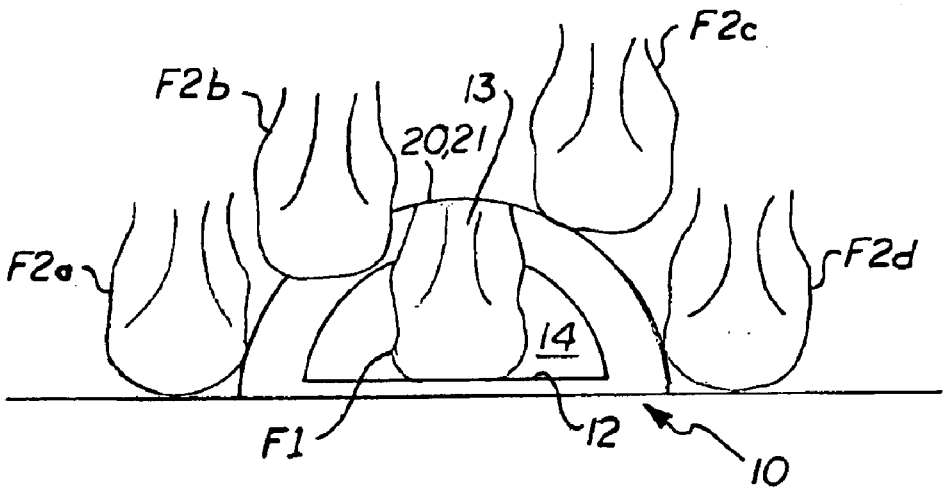
FIGS. 6 and 6A are illustrations showing different ways a foot can be rubbed on the foot scrubber.

FIG. 6 shows the left foot F1 from behind the heel holding the foot scrubber 10 stationary. The motion of the right foot F2 is basically forward and backward. The right foot F2 is shown at four positions F2*a*, F2B, F2*c* and F2*d* around the scrubbing surface. In each of these positions the right foot is moving forward and backward. F2*a* illustrates scrubbing the outside of the foot including the side of the little toe and side of the heel. F2*b* illustrates scrubbing the bottom and outside of the foot. F2*c* illustrates scrubbing the bottom, arch and inside side of the foot. F2*d* illustrates scrubbing the inside of the foot including the side of the big toe, side of the arch and side of the heel.

Figure 6A:
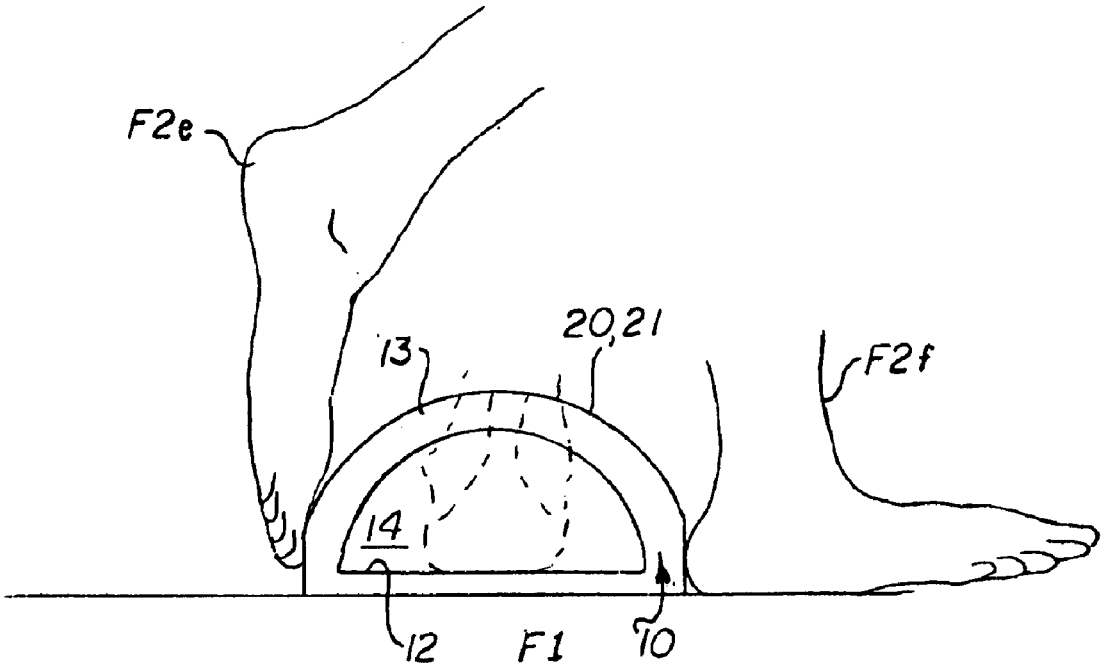

FIG. 6A shows, somewhat schematically, the right foot F2 turned sideways. The foot motion here is basically up and down. F2*e* illustrates scrubbing the top of the foot and top of the toes. F2*e* illustrates scrubbing the back side of the heel.

The foot is capable of a full range of motions, including forward, backward, up, down and side to side. Through rotation at the ankle, the foot is capable of a full range of approach angles. The configuration of the foot scrubber 10 provides an optimally shaped scrubbing surface, which the foot can work against.

The foot scrubber 10 may also be held by the hand of the user to scrub other body parts where the skin is thicker, such as the knee and elbows. The foot scrubber can also be used on body parts where additional stimulation and blood circulation is desired, like the buttocks.

While this invention has been described fully and completely with special emphasis upon preferred embodiments, it should be understood that within the scope of the appended claims, the invention may be practiced otherwise than as specifically described herein.

What is claimed is:

1. A method for scrubbing the feet of a user, comprising the steps of:

providing a rigid generally D-shaped foot receiving member having a flat generally rectangular bottom portion, an outwardly curved generally dome-shaped top portion extending upwardly from laterally opposed sides of said bottom portion spaced above a top surface of said bottom portion defining an open ended generally D-shaped opening for receiving a foot of a user, said bottom portion and said curved generally dome-shaped top portion each having inner and outer facing surfaces, said outwardly curved generally dome-shaped top portion sized and shaped to facilitate scrubbing of contoured surfaces of the foot of the user, and a layer of textured fabric scrubbing material covering said inner and outer facing surfaces of said bottom portion and said outwardly curved generally dome-shaped top portion;

wetting and applying soap to said textured fabric scrubbing material;

placing said bottom portion of said D-shaped foot receiving member on a flat support surface;

inserting one foot into said D-shaped opening and exerting force on said bottom portion to hold it stationary on the flat support surface; and scrubbing the other foot by rubbing it against said textured fabric scrubbing material on said outer facing surface of said top portion.

2. A foot scrubbing device, comprising:

a rigid generally D-shaped foot receiving member having a flat generally rectangular bottom portion, an outwardly curved generally dome-shaped top portion extending upwardly from laterally opposed sides of said bottom portion spaced above a top surface of said bottom portion defining an open ended generally D-shaped opening for receiving a foot of a user;

said bottom portion and said curved generally dome-shaped top portion each having inner and outer facing surfaces;

said outwardly curved generally dome-shaped top portion sized and shaped to facilitate scrubbing of contoured surfaces of the foot of the user; and a layer of textured fabric scrubbing material covering said inner and outer facing surfaces of said bottom portion and said outwardly curved generally dome-shaped top portion;

said foot receiving member being held against a flat support surface by the user placing one foot into said D-shaped opening and exerting force on said bottom portion while the other foot is scrubbed by rubbing it against said textured fabric scrubbing material on said outer facing surface of said top portion.

* * * * *